US008066071B2

(12) United States Patent
Sharma et al.

(10) Patent No.: US 8,066,071 B2
(45) Date of Patent: Nov. 29, 2011

(54) DIVERTER VALVE

(75) Inventors: Ashish Sharma, Friendswood, TX (US); Gregory Daniel, Pearland, TX (US); Barry Scott Stringfield, Pearland, TX (US); Robert Krush, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 461 days.

(21) Appl. No.: 12/261,184

(22) Filed: Oct. 30, 2008

(65) Prior Publication Data

US 2009/0114393 A1 May 7, 2009

Related U.S. Application Data

(60) Provisional application No. 60/984,579, filed on Nov. 1, 2007.

(51) Int. Cl.
*E21B 43/16* (2006.01)

(52) U.S. Cl. ..... 166/305.1; 166/322.3

(58) Field of Classification Search ..... 166/305.1, 166/332.3, 316; 251/73, 145, 153, 333; 137/511, 137/512, 515

See application file for complete search history.

(56) References Cited

U.S. PATENT DOCUMENTS

| | | | | |
|---|---|---|---|---|
| 2,726,723 | A * | 12/1955 | Wilhoit et al. | 166/325 |
| 3,642,069 | A * | 2/1972 | Adkins | 166/301 |
| 5,819,853 | A * | 10/1998 | Patel | 166/373 |
| 7,066,264 | B2 | 6/2006 | Bissonnette | |
| 7,775,284 | B2 * | 8/2010 | Richards et al. | 166/329 |
| 2007/0272411 | A1 | 11/2007 | Lopez De Cardenas | |
| 2008/0041580 | A1 * | 2/2008 | Freyer et al. | 166/193 |
| 2009/0084553 | A1 | 4/2009 | Rytlewski | |
| 2010/0024889 | A1 * | 2/2010 | Walker et al. | 137/12 |

FOREIGN PATENT DOCUMENTS

DE 4220586 A1 * 1/1994

* cited by examiner

*Primary Examiner* — Daniel P Stephenson

(74) *Attorney, Agent, or Firm* — David Matthews; Rodney Warfford

(57) ABSTRACT

Apparatus for multi-zone wellbores that can by-pass upper hydrocarbon bearing zones and deliver fluid to lower hydrocarbon bearing zones. The apparatus can include at least one housing, and at least one port can be formed through the housing. An inner sleeve can be positioned within the housing. At least one cavity can be radially disposed on an outer diameter of the inner sleeve, and each cavity can be located within an annulus formed between the inner sleeve and the housing. A ball can be disposed within each cavity, and the ball can be adapted to selectively engage the port.

16 Claims, 2 Drawing Sheets

DIVERTER VALVE

CROSS-REFERENCE TO RELATED APPLICATIONS

This application claims priority to U.S. Provisional Patent Application having Ser. No. 60/984,579, filed on Nov. 1, 2007, which is incorporated by reference herein.

BACKGROUND

Hydrocarbon fluids such as oil and natural gas are obtained from subterranean geological formations, which are referred to as reservoirs. To recover hydrocarbons from a reservoir, a well that penetrates the reservoir is drilled. After the well is drilled, it must be completed before hydrocarbons can be produced.

A well completion involves the design, selection, and installation of equipment in or around the wellbore for conveying, pumping, or controlling production or injection of fluids into the wellbore. After the well is completed production of hydrocarbons can commence.

Sometimes, multiple hydrocarbon bearing zones are intersected by a drilled wellbore. As such, when a tubular is deployed within the wellbore, it may be desirable to by-pass upper hydrocarbon bearing zones and deliver fluid directly to a lower hydrocarbon bearing zone. A need exists, therefore, for an apparatus that can facilitate the direct flow of fluid to the lower hydrocarbon bearing zone while still allowing in flow from an upper hydrocarbon bearing zone.

SUMMARY

Apparatus for multi-zone wellbores that can by-pass upper hydrocarbon bearing zones and deliver fluid to lower hydrocarbon bearing zones, and methods for using the same are provided. In at least one specific embodiment, the apparatus can include at least one housing, and at least one port formed through the housing. An inner sleeve can be positioned within the housing. At least one cavity can be radially disposed on an outer diameter of the inner sleeve, and each cavity can be located within an annulus formed between the inner sleeve and the housing. A ball can be disposed within each cavity, and the ball can be adapted to selectively engage the port.

In at least one specific embodiment, the method comprises locating a fluid delivery system into a wellbore. The fluid delivery system comprises a tubing string; a flow diverter valve; and a delivery device. The flow diverter valve comprises at least one housing; at least one port formed through the housing; an inner sleeve positioned within the housing; at least one cavity radially disposed on an outer diameter of the inner sleeve, wherein each cavity is located within an annulus formed between the inner sleeve and the housing; and a ball disposed within each cavity, wherein the ball is adapted to selectively engage the port. The delivery device is positioned adjacent to a lower hydrocarbon bearing zone, and a fluid is provided into the tubing string. The fluid flow causes the balls to engage the ports thereby preventing fluid flow from the housing.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

As used herein, the terms "up" and "down"; "upper" and "lower"; "upwardly" and "downwardly"; "upstream" and "downstream"; and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Figure 1:
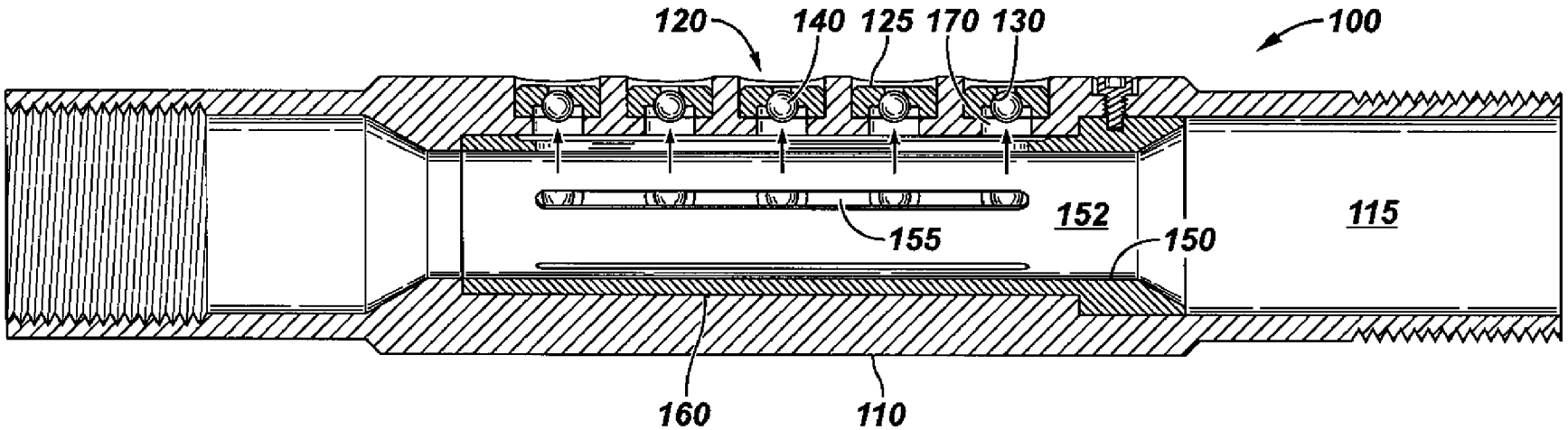
FIG. 1 depicts a partial cross section of an illustrative diverter valve, according to one or more embodiments described.

FIG. 1 depicts a partial cross section of an illustrative diverter valve 100, according to one or more embodiments. The flow diverter valve 100 can include one or more housings 110, one or more openings or ports 120 each adapted to sealing engage a floating ball 140 disposed within a cavity 170 formed between the housing 110 and an inner sleeve 150. The housing 110 can be a tubular member having a bore 115 formed therethrough. The bore 115 can be in selective communication with the exterior of the flow diverter valve 100 through the one or more opening or ports 120 formed through the housing 110. Five ports 120 are shown although any number of ports 120 can be used, depending on the length of the housing 110 and the type of port pattern and circumferential distribution. For example, one, two, three, four, five, six, seven, eight, or nine or more ports 120 can be disposed about the housing 110.

Each port 120 can be a hole or extrusion formed through the wall of the housing 110. The cross section of each port 120 can be any shape and size conducive to regulate flow therethrough. For example, the port 120 can have a circular, squared, rectangular, triangular, or any other polygonal shaped cross section. Each port 120 can have the same shape and/or size, or each port 120 can differ.

An insert 125 can be disposed within each port 120. The insert 125 can be any shape and size body that can be inserted inside the port 120 and held in place by screws, threads or tight fit. The outside diameter of the insert 125 may or may not confirm to the outside diameter of the housing 110. The insert 125 can engage the inner diameter or bottom face of the port 120 to form a thread sealing, metal to metal sealing, or an O-ring sealing arrangement. In one or more embodiments, the insert 125 may also be large enough to contain multiple ports 120 within it and can be mounted inside a large slot (not shown) in the housing 110, with a sealing surface provided between the slot and the insert 125 by a thread sealing, a metal to metal sealing, or an O-ring sealing arrangement.

A seat 130 can be formed in the insert 125 to provide a sealing surface for a ball 140. The seat 130 can simply be a tapered or profiled hole formed in the insert 125. Each seat 130 can be centrally located on the insert 125 and can allow fluid to pass therethrough when not engaged with a ball 140. Likewise, no fluid can pass through the hole of the insert 125 when the ball 140 is sealingly engaged against the seat 130.

The seat 130 is preferably tapered or profiled to conform to the outer diameter of the ball 140.

The inner sleeve 150 can be concentrically disposed within the bore 115 of the housing 110. One or more slots 155 can be formed into the exterior of the inner sleeve 150. The slots 155 can be axially disposed about the sleeve 150 and equally spaced about the diameter thereof. The slots 155 can allow for fluid to pass therethrough, however, the slots 155 can have a smaller slot width than the diameter of the balls 140, thereby, blocking the balls 140 from passing into the bore 152 of the sleeve 150.

The inner sleeve 150 and the housing 110 form an annulus 160 therebetween. One or more cavities 170 or channels can be disposed within the annulus 160. Each cavity 170 can be formed by an extension or protrusion that is disposed radially outward from the internal sleeve 150. The cavities 170 can be configured to align with the ports 120 and to provide a housing or cup for the balls 140. During operation, each ball 140 can radially move within its cavity 170 to either seal off the adjoining port 120 in a first position or open the adjoining port 120 in a second position.

When fluid pressure within the housing 110 exceeds the pressure outside the housing 110, the balls 140 can engage the port 120 and/or the seat 130, as shown in FIG. 1, and referred to herein as the first position. In this first position, the balls 140 can prevent or block fluid flow from within the housing 110 to outside the housing 110. In the alternative, if the pressure outside of the housing 110 is higher than the pressure within, the balls 140 can engage the inner sleeve 150, as depicted in FIG. 2, and referred to herein as the second position.

Figure 2:
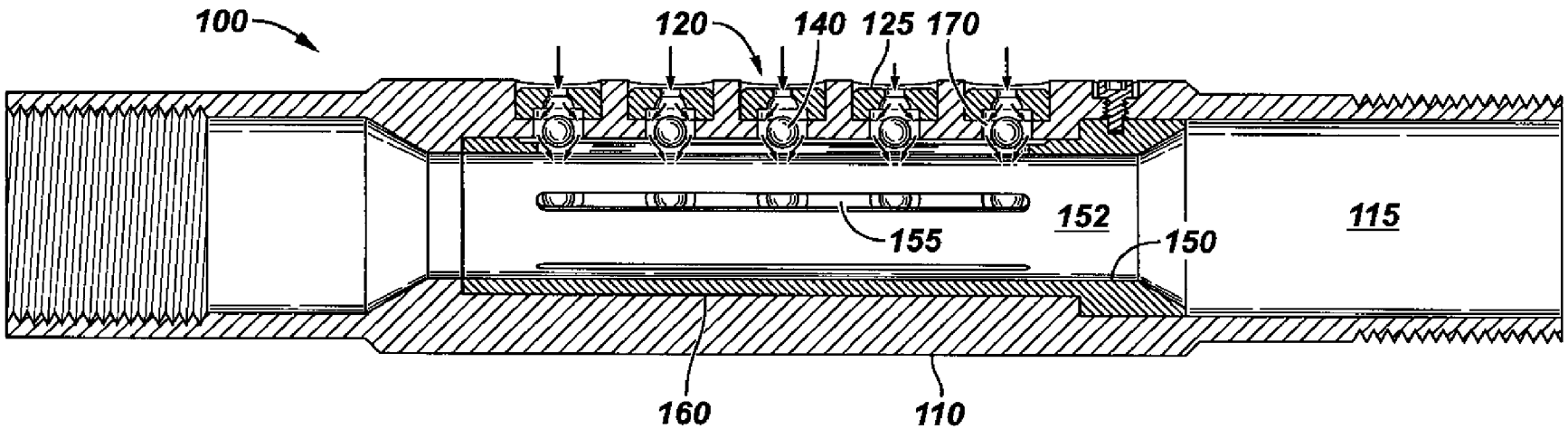
FIG. 2 depicts a partial cross section of the diverter valve of FIG. 1 configured to allow fluid flow into the housing, according to one or more embodiments described.

FIG. 2 depicts a partial cross section of the diverter valve 100 of FIG. 1 configured to allow fluid flow into the housing 110 ("second position"), according to one or more embodiments. As shown in FIG. 2, exterior pressure can push the balls 140 radially inward against the inner sleeve 150 but are prevented from migrating into the bore 152 of the sleeve 150 by the configuration of the slots 155 as discussed above. When the balls 140 are disengaged from the ports 120 and/or seats 130 fluid is free to flow through the ports 120 into the bore 115 of the housing 110.

Figure 3:
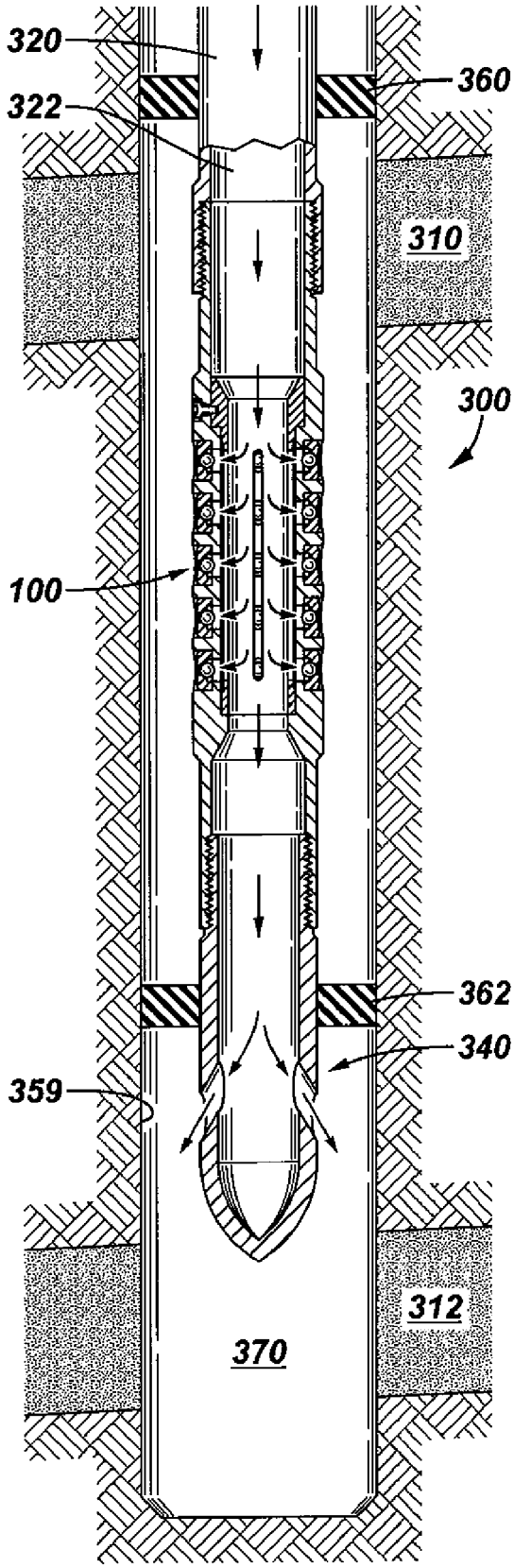
FIG. 3 depicts an illustrative fluid delivery system disposed within a wellbore, according to one or more embodiments described.

FIG. 3 depicts an illustrative fluid delivery system 300 disposed within a wellbore, according to one or more embodiments. The fluid delivery system 300 can include an upper tubing string 320, the flow diverter valve 100, and a delivery device 340. The system 300 can be adapted to divert fluid flow past an "upper" or first zone 310 to a "lower" or second zone 312 within the wellbore.

In one or more embodiments, the first end of the flow diverter valve 100 can be connected to the upper tubing string 320. The delivery device 340 can be positioned adjacent the second end of the upper flow diverter valve 100. The delivery device 340 can simply be a mandrel or tubular body with holes or ports formed therethrough or any other device used to deliver fluid to a subterranean hydrocarbon bearing zone, such as the second hydrocarbon bearing zone 312. In one or more embodiments, an illustrative delivery device 340 can be wash pipe.

In one or more embodiments, the upper tubing string 320 can have a length sufficient to position the flow diverter valve 100 adjacent or proximate to the first hydrocarbon bearing zone 310. The length of the delivery device 340 can be sufficient such that it is positioned adjacent to or proximate to the second hydrocarbon bearing zone 312. In one or more embodiments, a spacer string, such as tubing, can be disposed between the flow diverter valve 100 and the delivery device 340 to increase the length of the delivery device 340. The length of the fluid delivery system 300 can be predetermined using logging information and other downhole data.

The fluid delivery system 300 can further include one or more sealing mechanisms (two are shown 360, 362). The sealing mechanisms 360, 362 can be packers, seals, or other sealing mechanisms capable of sealing the annulus 370 of the wellbore 359. The sealing mechanisms 360, 362 can be used to separate or isolate the wellbore 359 between the first hydrocarbon bearing zone 310 and the second hydrocarbon bearing zone 312. For example, the sealing mechanisms 360, 362 can be positioned along the fluid delivery system 300, such that at least one sealing mechanisms 360, 362 can be positioned above and below each hydrocarbon bearing zone 310, 312.

The fluid delivery system 300 can allow fluid pumped or otherwise provided to the upper tubing string 320 to by-pass the first hydrocarbon bearing zone 310 to the second hydrocarbon bearing zone 312. As fluid flows from the inner bore 322 of the upper tubing string 320 through the valve 100, the pressure within the valve 100 can increase and force the balls 140 to engage the ports 120 and/or seat 130, as depicted in FIG. 1. The fluid, therefore, can be prevented from flowing to the first hydrocarbon bearing zone 310, and will be directed to the second hydrocarbon bearing zone 312 via the delivery device 340.

When the pressure outside the housing 110 is greater than the pressure within the housing 110, the balls 140 will move towards the inner sleeve 150 and the fluid will be allowed to flow through the ports 120 into the housing 110 of the valve 110, as depicted in FIG. 2. As the fluid flows through the valve 110, the fluid can continue into the bore 322 of the upper string 320. In one or more embodiments above or elsewhere herein, the fluid can be a treatment fluid although the fluid can be any fluid known in the art for drilling, completing, servicing or working over a well.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An apparatus for use in a multi-zone wellbore for by-passing an upper hydrocarbon bearing zone and delivering fluid to a lower hydrocarbon bearing zone, wherein the apparatus comprises:

at least one housing;

a plurality of ports formed through the housing;

an inner sleeve positioned within the housing;

at least one cavity radially disposed on an outer diameter of the inner sleeve, wherein each cavity is located within an annulus formed between the inner sleeve and the housing; and a ball disposed within each cavity, wherein the ball is adapted to selectively engage the port.

2. The apparatus of claim 1, wherein at least one of the ports is radially aligned with the at least one cavity.

3. The apparatus of claim 2, wherein the at least one cavity is adapted to allow radial movement of the ball, and restrict axial movement of the ball.

4. The apparatus of claim 1, wherein an insert in disposed within at least one of the ports and wherein the insert has a seat disposed about a hole, and wherein the ball engages the seat.

5. The apparatus of claim 4, wherein the seat and ball form a seal.

6. The apparatus of claim 4, wherein the housing comprises an axial slot, and wherein the insert comprising at least one preformed port is disposed within the axial slot in the housing.

7. The apparatus of claim 1, wherein the inner sleeve comprises at least one longitudinal slot, and wherein the size of the slot is smaller than the diameter of the ball.

8. The apparatus of claim 1, wherein the inner sleeve is connected to the housing.

9. A fluid delivery system for providing fluid in a multi-zone borehole to a lower hydrocarbon bearing zone comprising:

a tubing string;

a flow diverter valve comprising:

at least one housing;

a plurality of ports formed through the housing;

an inner sleeve positioned within the housing;

at least one cavity radially disposed on an outer diameter of the inner sleeve, wherein each cavity is located within an annulus formed between the inner sleeve and the housing; and a ball disposed within each cavity, wherein the ball is adapted to selectively engage the port; and a delivery device.

10. The system of claim 9, wherein the tubing string is coiled tubing or other downhole pipe.

11. The system of claim 9, wherein the delivery device is a wash pipe.

12. The system of claim 9, wherein an insert is disposed within at least one of the ports and wherein the insert has a seat disposed about a hole, and wherein the ball engages the seat.

13. The system of claim 9, wherein each port is aligned with one of the cavities.

14. The apparatus of claim 9, wherein the at least one cavity is adapted to allow radial movement of the ball, and restrict axial movement of the ball.

15. The system of claim 9, wherein the inner sleeve is secured to the housing.

16. A method for by-passing an upper hydrocarbon bearing zone and delivering fluid to a lower hydrocarbon bearing zone comprising:

locating a fluid delivery system into a wellbore, wherein the fluid delivery system comprises:

a tubing string;

a flow diverter valve comprising:

at least one housing;

at least one port formed through the housing;

an inner sleeve positioned within the housing;

at least one cavity radially disposed on an outer diameter of the inner sleeve, wherein each cavity is located within an annulus formed between the inner sleeve and the housing; and a ball disposed within each cavity, wherein the ball is adapted to selectively engage the port; and a delivery device;

positioning the delivery device adjacent to a lower hydrocarbon bearing zone;

flowing fluid through the tubing string, wherein the fluid flow causes the at least one ball to engage the at least one port thereby preventing fluid flow from the housing.

* * * * *